US010449401B2

(12) United States Patent
Coffey

(10) Patent No.: US 10,449,401 B2
(45) Date of Patent: Oct. 22, 2019

(54) DEVICE AND METHOD FOR DEPLOYING A TEMPORARY SPRINKLER ON A ROOF TOP

(71) Applicant: Bryan David Coffey, Salmon Arm (CA)

(72) Inventor: Bryan David Coffey, Salmon Arm (CA)

( * ) Notice: Subject to any disclaimer, the term of this patent is extended or adjusted under 35 U.S.C. 154(b) by 0 days.

(21) Appl. No.: 15/675,454

(22) Filed: Aug. 11, 2017

(65) Prior Publication Data

US 2018/0043196 A1 Feb. 15, 2018

Related U.S. Application Data

(60) Provisional application No. 62/373,501, filed on Aug. 11, 2016.

(30) Foreign Application Priority Data

Aug. 11, 2016 (CA) ..... 2938837

(51) Int. Cl.
*A62C 31/28* (2006.01)
*B05B 15/62* (2018.01)
*A62C 3/02* (2006.01)

(52) U.S. Cl.
CPC ..... *A62C 31/28* (2013.01); *A62C 3/0214* (2013.01); *B05B 15/62* (2018.02)

(58) Field of Classification Search
CPC ..... A62C 31/28; A62C 3/0214; B05B 15/62
(Continued)

(56) References Cited

U.S. PATENT DOCUMENTS 6,360,968 B1 * 3/2002 Orrange ..... A62C 3/0214 169/16
6,824,073 B1 * 11/2004 Haney ..... A62C 3/0292 239/208

(Continued)

FOREIGN PATENT DOCUMENTS

CA 2618904 7/2009

OTHER PUBLICATIONS

"Wildfire Automated Sprinkler Protection", sourced from www.waspwildfire.com/the-wasp/wasp-gutter-mount-sprinkler-system/, having a copyright date of 2018.

(Continued)

*Primary Examiner* — Chee-Chong Lee
(74) *Attorney, Agent, or Firm* — Antony C. Edwards

(57) ABSTRACT

The present application discloses a ground-deployable, roof-top-situated wildfire defense sprinkler system, which may be safely and quickly installed onto peaks of the roof by one or two people working from the ground, and which may also be safely and quickly removed from the roof once the equipment is no longer required; the sprinkler comprising a clam shell frame having an upper surface and a lower surface, at least one front skid pivotally coupled at a pivotal coupling to at least one rear skid so that the front and rear skids rotate relative to one another about an axis of rotation at the pivotal coupling, a translation means mounted to the frame, at least one connection point mounted to the frame and positioned adjacent the axis of rotation, a sprinkler mast mounted to the frame and adapted to extend upwardly therefrom and adapted for mounting a sprinkler head thereon.

21 Claims, 15 Drawing Sheets

(58) Field of Classification Search
USPC ..... 239/1
See application file for complete search history.

(56) References Cited

U.S. PATENT DOCUMENTS

| | | | | |
|---|---|---|---|---|
| 6,964,379 | B2 * | 11/2005 | Crowley | B05B 15/70 239/208 |
| 7,673,696 | B1 * | 3/2010 | Gunn | A62C 3/00 169/46 |
| 8,590,808 | B2 | 11/2013 | Roach | |
| 9,423,070 | B2 | 8/2016 | Pyke | |
| 2004/0140106 | A1 * | 7/2004 | De Anda-Uribe | A62C 3/06 169/66 |
| 2005/0092502 | A1 * | 5/2005 | Thompson | A62C 5/02 169/24 |
| 2008/0289830 | A1 | 11/2008 | Olson | |
| 2009/0200044 | A1 * | 8/2009 | Durkin | A62C 3/0292 169/16 |
| 2009/0301736 | A1 | 12/2009 | Tieck | |

OTHER PUBLICATIONS

"Ember Defender Roof Sprinkler", sourced from www.emberdefender.com.au having a copyright date of 2017.
"Roof Saver Sprinklers—An Affordable Home Wildfire Protection System", sourced from www.roofsaversprinklers.com having a copyright date of 2010-2018.
"Elevated Sprinkler Mount on a OTR", sourced from www.asroachfire.com/general-information/ having a copyright date of 2018.
Rooftop Sprinklers—FAQ, sourced from www.sandiegorooftopsprinklers.com/rooftop_sprinkler_pictures.php.
Flash Fire & Safety, "Complete Roof Sprinkler Systems", www.flashfiresafety.com/wildland-complete-50-foot-roof-sprinkler-systems/.

* cited by examiner

DEVICE AND METHOD FOR DEPLOYING A TEMPORARY SPRINKLER ON A ROOF TOP

CROSS-REFERENCE TO RELATED APPLICATIONS

This application claims priority to U.S. Provisional patent application No. 62/373,501 filed on Aug. 11, 2016, which is hereby incorporated by reference in its entirety.

FIELD

The present application relates to fire protection devices. In particular, this application relates to a device and method for deploying a temporary sprinkler on the surface of a roof, providing protection to the roof and structure in the vicinity of an uncontrolled fire.

BACKGROUND

Sprinklers are proven to be highly effective weapons for defending structures against interface wildfire situations, particularly when the sprinklers are placed on the highest roof peaks. However, roofs are dangerous to climb, especially when everything is wet and smoky and the firefighters are in a hurry to deploy the sprinklers ahead of an approaching wildfire. Many rural and interface property structures, which are in locations most likely to be impacted by wildfire, utilize steep roof constructions so that snow will slide off. These steep roof constructions are particularly dangerous roofs to get a ladder up to the peak, and represent a significant danger to firefighting personnel to attempt such a feat.

Conventional structure defense sprinkler equipment requires a firefighter to climb to the peak of the roof, set up a sprinkler apparatus, and then secure the sprinkler apparatus to the roof using nails or other means. In addition, many structures will require more than one sprinkler to be installed. Safely climbing the roof requires the firefighter to firstly install a rope over the roof so that the firefighter may anchor himself to the roof in case he slips. The process of installing structure defense sprinkler equipment during wildfires is dangerous and time consuming, all of which is undesirable when firefighters are attempting to save structures from wildfires which may be fast moving and unpredictable.

Similarly, once the danger of the wildfire has passed, the removal of most prior art structure defense sprinkler equipment requires a firefighter to climb back onto the roof, remove any nails or other fasteners, and fill any holes. As a result, firefighters are typically put into dangerous situations when installing and/or removing rooftop structure defense sprinkler equipment. Thus, there is a need for structure defense sprinklers which may be relatively quickly and safely installed on and removed from a structure's roof, without requiring a firefighter or other person to climb a ladder or otherwise climb onto the roof in order to install the structure defense sprinkler.

SUMMARY

The present application discloses a ground-deployable, rooftop-situated wildfire defense sprinkler device, which may be quickly and safely installed on even the highest peaks of the roof by one or two people working from the ground, and which may also be quickly and safely removed from the roof once the equipment is no longer required. The application also discloses methods for deploying a rooftop sprinkler device.

In some embodiments of the present disclosure, a rooftop sprinkler device for mounting to a roof includes a clam shell frame having an upper surface, a lower surface, at least one front skid pivotally coupled to at least one rear skid at a pivotal coupling so that the front and rear skids rotate relative to one another about an axis of rotation at the pivotal coupling, a translation means mounted to or otherwise on the frame so that a lower surface of the translation means protrudes below at least a portion of the lower surface of the frame, at least one connection point mounted to the frame and positioned adjacent the axis of rotation and a sprinkler mast mounted to the frame so as to extend upwardly therefrom and adapted for mounting a sprinkler head on a free end of the mast. The mast is in fluid communication with a hose coupling for the supply of water to the sprinkler head. The translation means translates the frame along and over first and second roof surfaces on opposing sides of the ridge of a roof when a pulling force is applied to the at least one connection point, the pulling force urging the frame over an outermost edge of the roof and then across the roof. When the frame is positioned over an apex of the roof the at least one front skid is positioned substantially flush against or parallel to the first surface and the at least one rear skid is positioned substantially flush against or parallel to the second surface, and the axis of rotation is positioned substantially on and along the apex of the roof. When a rigging assembly, which for example may include a lanyard, is attached to the at least one connection point, the frame may then be hoisted by the rigging assembly from a ground position to an elevated position at the roof edge where the translation means first engages the roof edge and further hoisting urges the frame over the edge and onto the roof.

In some embodiments, the translation means includes at least two wheels rotationally coupled to the frame. The first and second support arms may each have a mast end and a skid end, wherein the mast ends of the first and second support arms are pivotally coupled to the mast, the skid end of the first support arm is pivotally coupled to the front skid, and the skid end of the second support arm is pivotally coupled to the rear skid. In other embodiments, the mast ends of the first and second support arms are coupled to a bracket and the bracket is slidingly coupled to the mast, wherein the bracket slides along the mast when an angle between the at least one front skid and the at least one rear skid changes. Furthermore, in some embodiments a resilient tensioning device, such as a spring, may be attached to both the front and rear portions of the frame so as to apply tension to the frame and thereby stabilize the frame in the desired configuration during hoisting.

In some embodiments of the rooftop sprinkler, the mast ends of the first and second support arms are releasably coupled to the bracket and the bracket comprises a plurality of adjustment apertures for coupling the mast ends to the bracket, wherein the angle between the mast and the at least one front skid or the at least one rear skid may be selected by selecting the adjustment apertures for releasably coupling the mast ends of the first and second support arms to the bracket. Other embodiments may include only one aperture on each side of the bracket so as to couple the mast ends of the first and second support arms to the bracket. Optionally, the first and second support arms may also be permanently attached to the bracket.

The sprinkler mast may include a hose connector which extends substantially towards the at least one rear skid. In other embodiments, the frame includes at least two rear skids and a rigid rear crossmember extending between and coupled to each of the at least two rear skids, and at least two front skids and a rigid front crossmember extending between and coupled to each of the at least two front skids, whereby a hose connected to the hose connector rests on the rear crossmember thereby stabilizing the frame during the hoisting and while situated on the roof.

In other embodiments of the present disclosure, a method for deploying a roof sprinkler device on a roof of a structure while positioned on a ground beside the structure includes the steps of: (a) coupling a hose to a hose coupling in fluid communication with a sprinkler mast and sprinkler head of the roof sprinkler, the sprinkler mast extending substantially orthogonally from a central crossmember pivotally coupled to front and rear portions of a clam shell frame, the clam shell frame supporting a translation means adapted for translating the roof sprinkler across a surface of the roof; (b) coupling a rigging assembly to the central crossmember; (c) throwing a free end of the rigging assembly over the roof from a first ground position, wherein the free end is accessible from a second ground position opposite the first ground position, the first and second ground positions separated by the structure; (d) applying a hoisting tension to the free end of the rigging assembly from the second ground position so as to hoist the roof sprinkler from the first ground position to an outermost edge of the roof until the translation means contacts the edge of the roof; and (e) applying the hoisting tension to the free end of the rigging assembly until the central crossmember is located substantially adjacent to a center line of the roof. In operation, the method includes the further step of supplying water to the hose so as to spray water from a sprinkler head coupled to a free end of the sprinkler mast.

DETAILED DESCRIPTION

Figure 1:
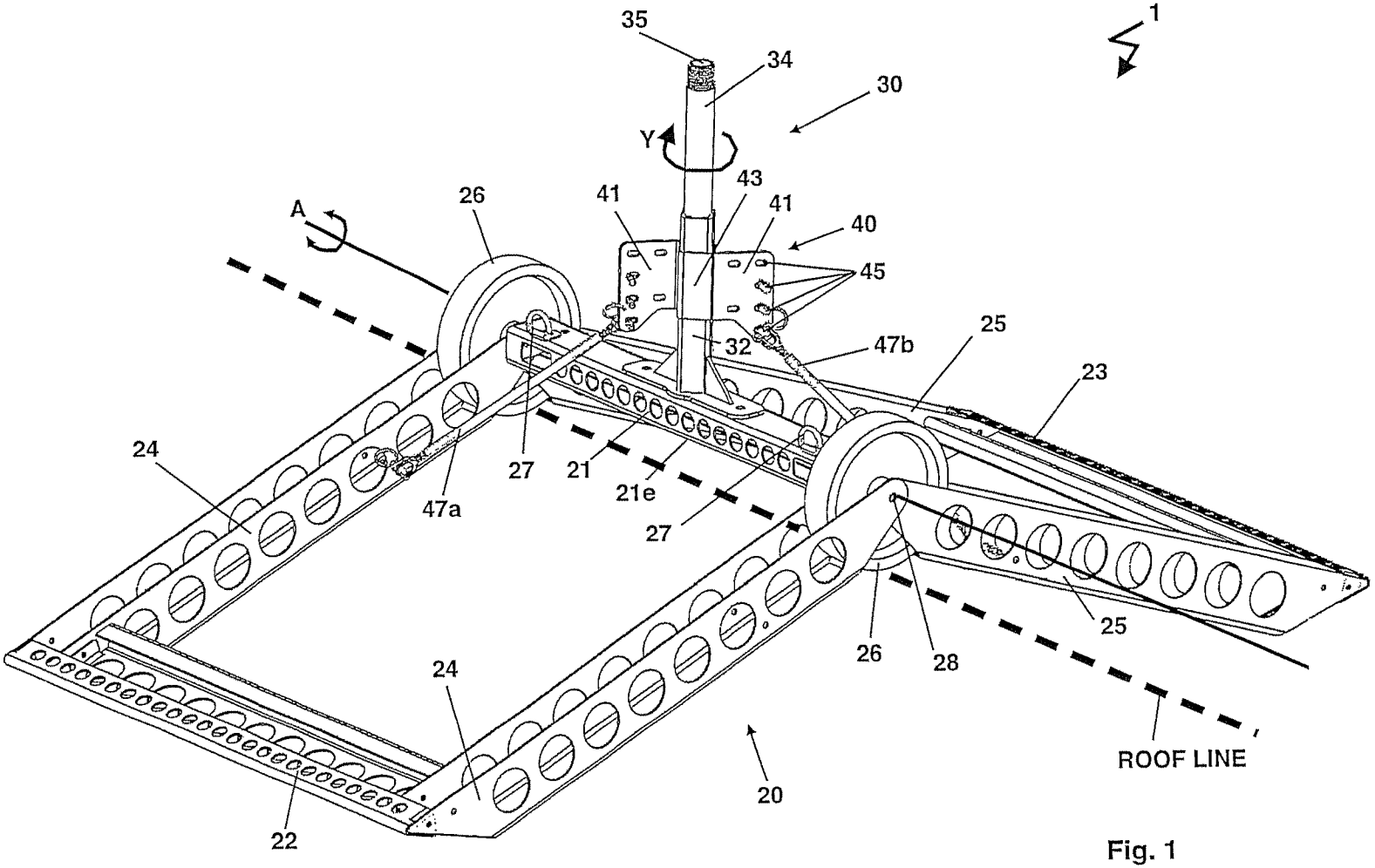
FIG. 1 is an isometric view of an embodiment of the rooftop sprinkler device disclosed herein.
Figure 2:
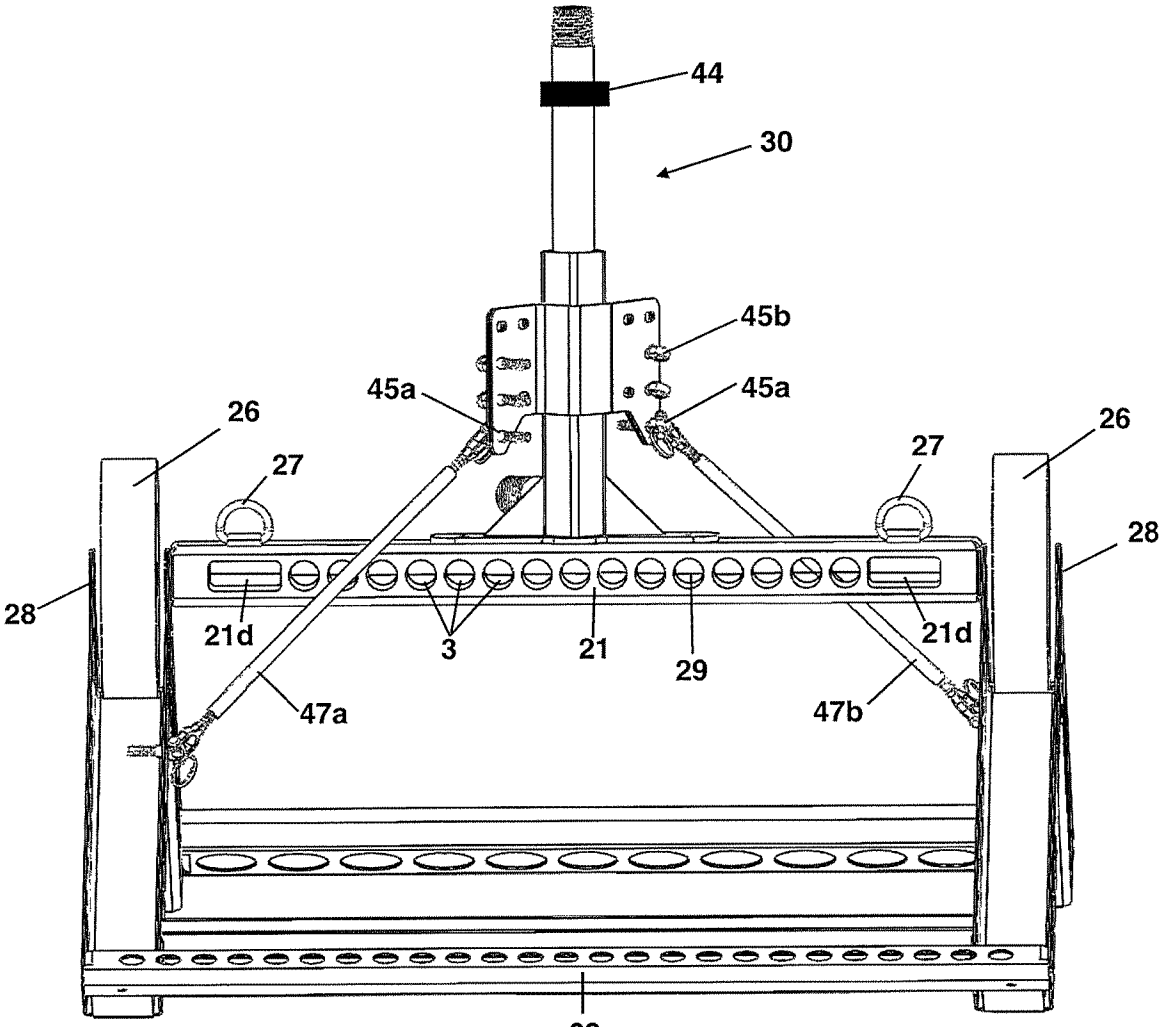
FIG. 2 is a front elevation view of the sprinkler shown in FIG. 1.

As illustrated in FIGS. 1-8, an embodiment or embodiments of a rooftop sprinkler 1 in accordance with the present disclosure is illustrated (the terms "roof sprinkler", "rooftop sprinkler" and "sprinkler" are used interchangeably herein). The sprinkler 1 comprises a clam shell frame 20 comprises a spaced apart pair of front skids 24 and a corresponding pair of rear skids 25, wherein corresponding front skids 24 and rear skids 25 are pivotally coupled to each other at pivotal couplings 28, 28, as best seen in FIGS. 1 and 2. An axis of rotation A runs through the pivotal couplings 28, 28. The front skids 24 and rear skids 25 are free to rotate in both directions about axis of rotation A, so as to rotate between the open position in FIG. 3 and the closed position in FIG. 6.

Figure 8:
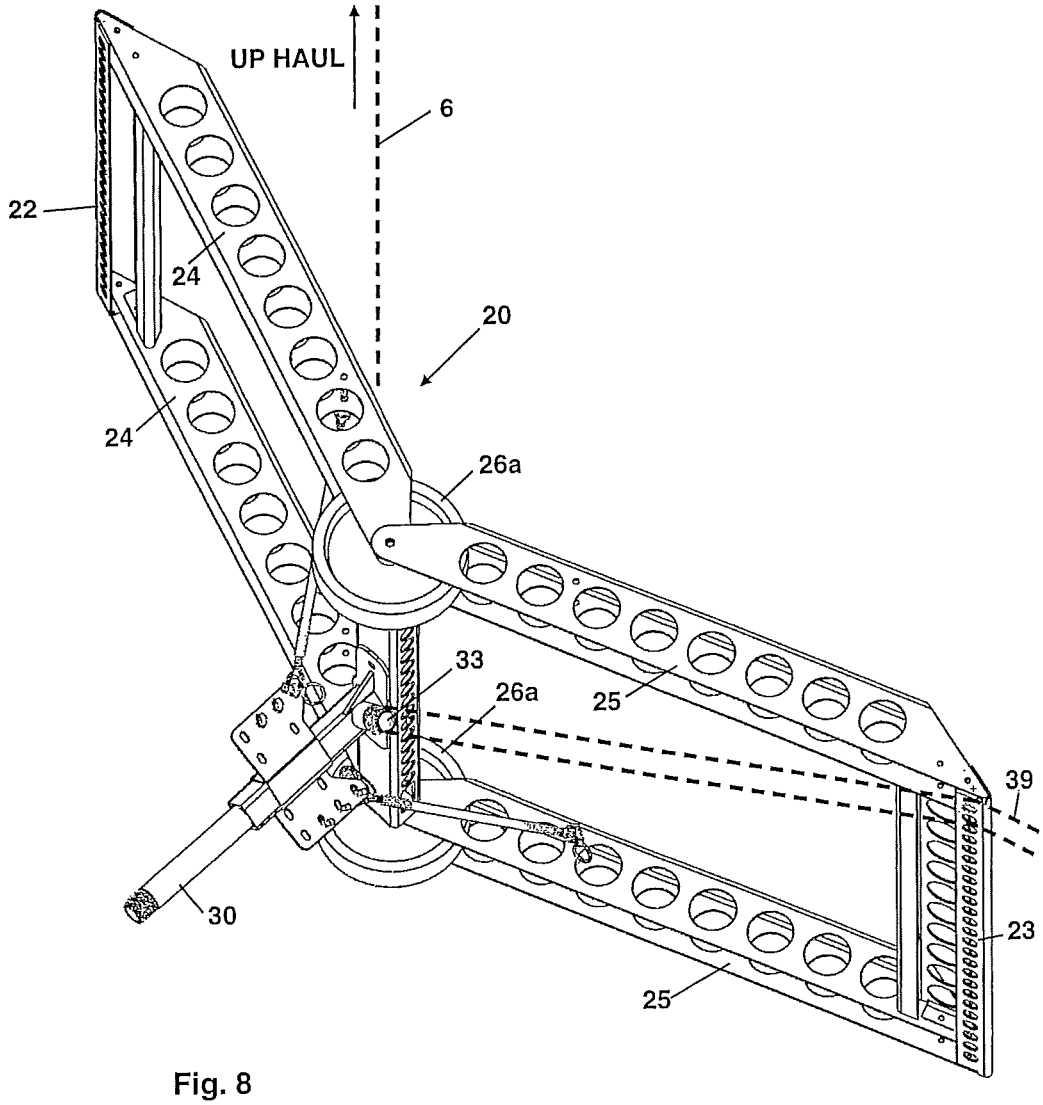
FIG. 8 is the side perspective view of the rooftop sprinkler shown in FIG. 3, illustrating the orientation of the sprinkler as it is being pulled to a roof.

In some embodiments, a central crossmember 21 is positioned between and coupled to each of the pivotal couplings 28, 28. A translation means 26 adapted for travelling over a rough surface, for example, over the surfaces of roofs of various constructions including tin shingle roofs, pine shake roofs and asphalt tile roofs, is provided. For example, as illustrated in FIGS. 1-8, the translation means may include a pair of wheels 26, 26 mounted to an axle 29 running through the center of central crossmember 21 (as best viewed in FIG. 2), such that a lower portion 26*a* of the wheels 26 extend below a lower portion of the front skids 24*a* and a lower portion of the rear skids 25*a* when the frame 20 is in the substantially planar open position, such as illustrated in FIGS. 3 and 8. Alternatively, the wheels 26, 26 may be coupled or mounted directly to a portion of the frame 20, as shown for example in FIG. 2A.

The example of the translation means constituting a pair of wheels 26, 26 mounted to an axle 29 or to the frame 20 is not intended to be limiting, and it will be understood by a person skilled in the art that any number of translation means suitably adapted for translating over rough or uneven surfaces may be utilized and fall within the present disclosure. Other examples of translation means include: a single wheel mounted on a laterally extending axis; a plurality of wheels mounted along a lateral axis and disposed laterally across the frame; one or more longitudinally extending blades, each having a plurality of in-line wheels. For example, a plurality of such longitudinally aligned blades may be mounted spaced laterally across the frame. Other translation means may include: a cylinder mounted laterally across the frame; a single or a plurality of endless rotating tracks; one or more skid plates or other substantially planar surfaces suitably adapted for translating over the edge of a roof; one or more skis; a spherical ball rotatably mounted to a support; a single or multiple lengths of stiff wire mounted longitudinally underneath the frame. The translation means may be mounted to, or adjacent to, any portions of the frame 20 and such configurations fall within the scope of the present disclosure.

Figure 2A:
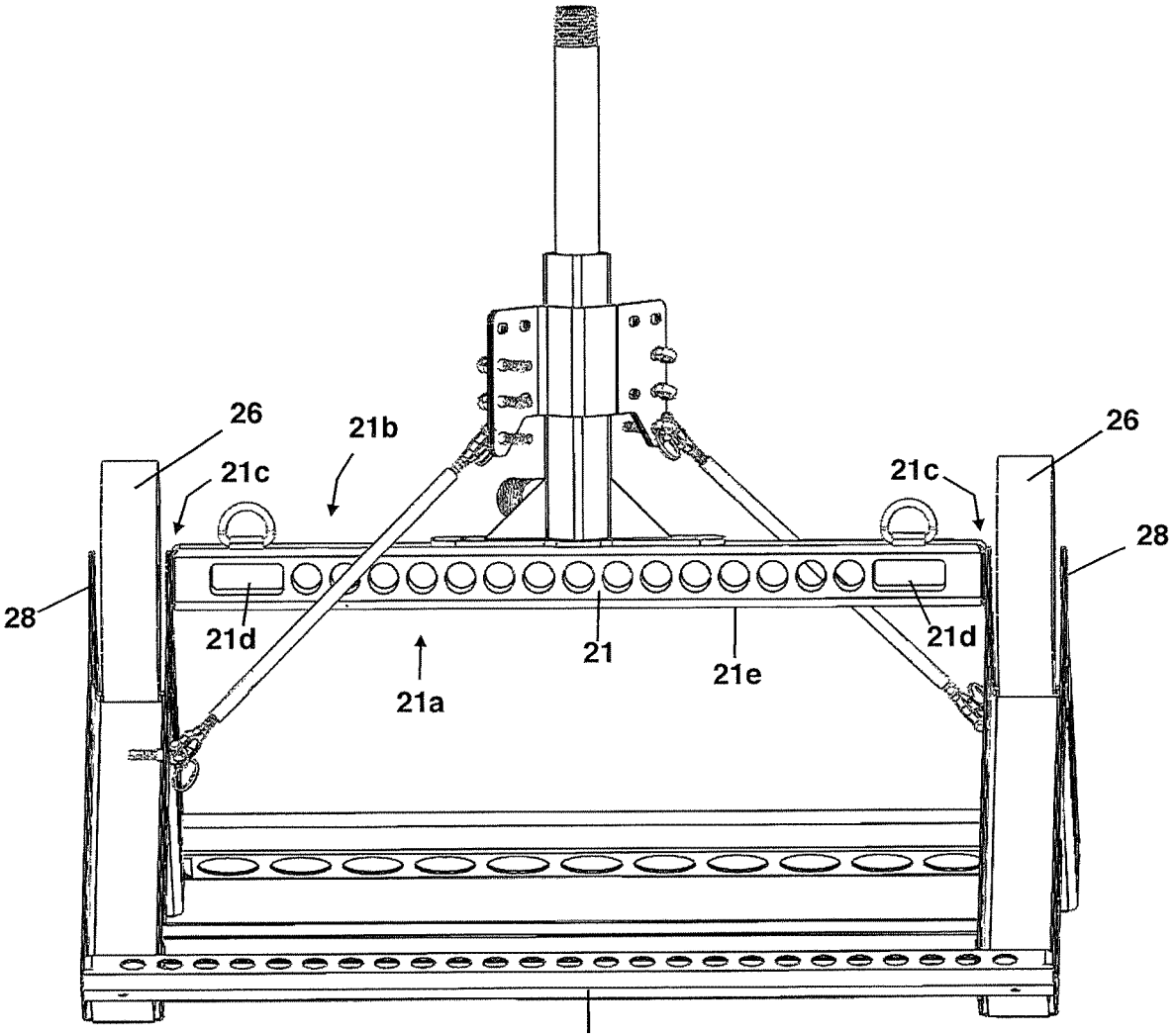
FIG. 2A is a front elevation view of the sprinkler, with the wheels mounted directly to the frame.
Figure 3:
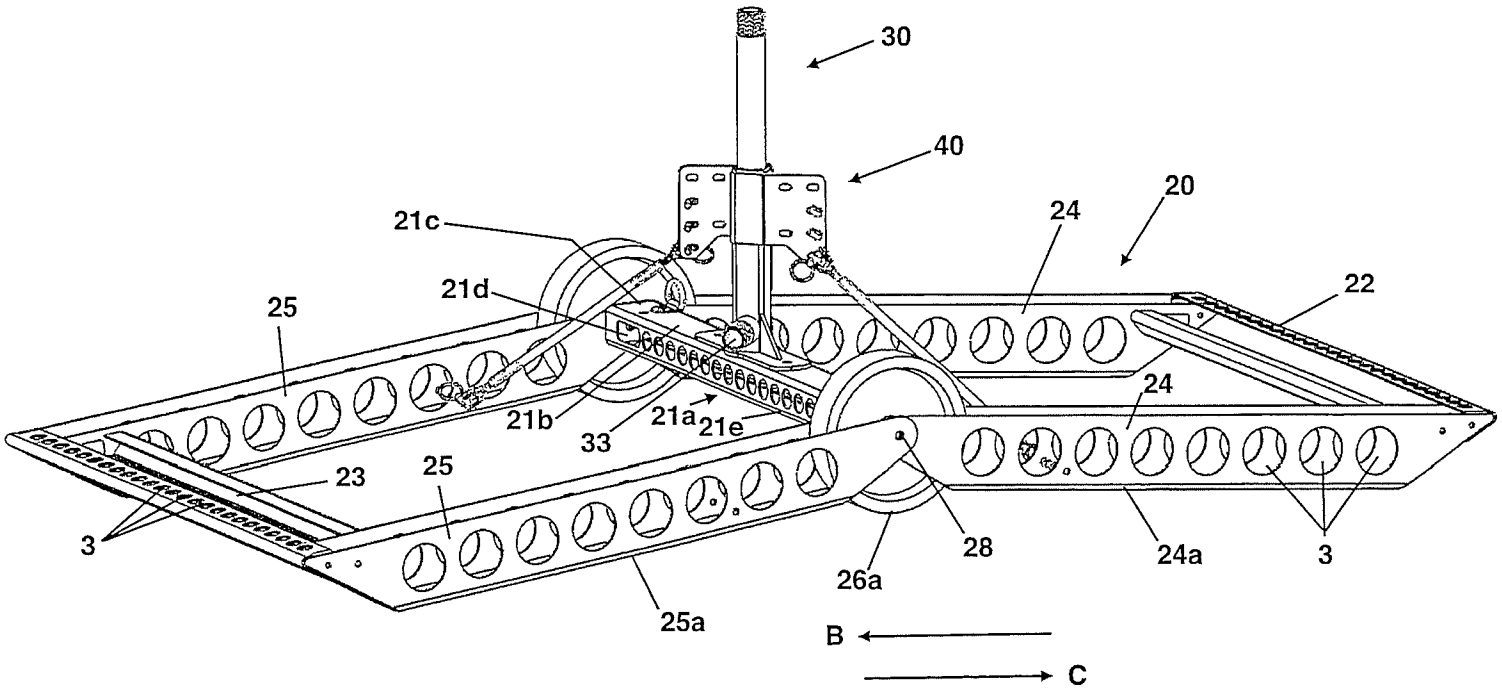
FIG. 3 is a side perspective view of the sprinkler of FIG. 1, configured in a fully extended position.

As best viewed in FIG. 2A, the central crossmember 21 includes a lower surface 21*a* and an upper surface 21*b*. A sprinkler mast 30 is mounted to the upper surface 21*b* of central crossmember 21, the sprinkler mast 30 comprising a lower portion 32 and an upper portion 34, whereby the lower portion 32 is adjacent the upper surface 21*b* of the central crossmember 21. A sprinkler coupling 35 is provided and at the distal uppermost end of the upper portion 34, distal from the central crossmember 21. The sprinkler coupling 35 is adapted for coupling to a sprinkler head, such as for an example a ¾ inch Rain Bird™ impact-style of sprinkler head, typically used for irrigation. However, a person skilled in the art will appreciate that other designs and sizes of sprinkler heads may be suitable and are within the scope of the present disclosure. In other embodiments the sprinkler head may be replaced with an aperture out of which water may exit in a pressurized stream and is also within the scope of the present disclosure.

A hose coupling 33, for coupling the water supply hose to the device, is mounted to the lower portion 32 of the mast 30. In the embodiment shown in FIGS. 1-8, hose coupling 33 is a standard ⅝ inch standard garden hose type fitting so as to be compatible with a regular garden hose; however, other hose couplings will work and are within the scope of this disclosure.

Figure 4:
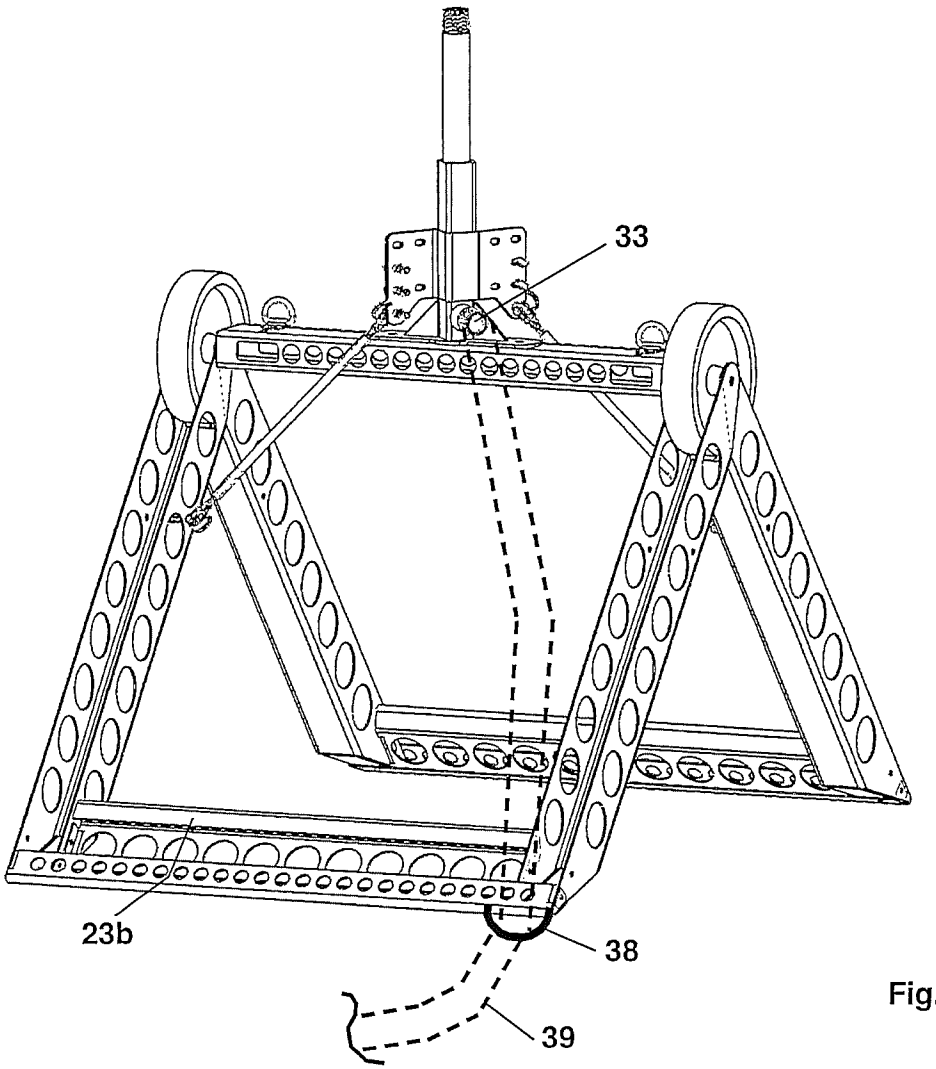
FIG. 4 is a side perspective view of the rooftop sprinkler of FIG. 1, configured in a position for a steeply pitched rooftop peak.
Figure 5:
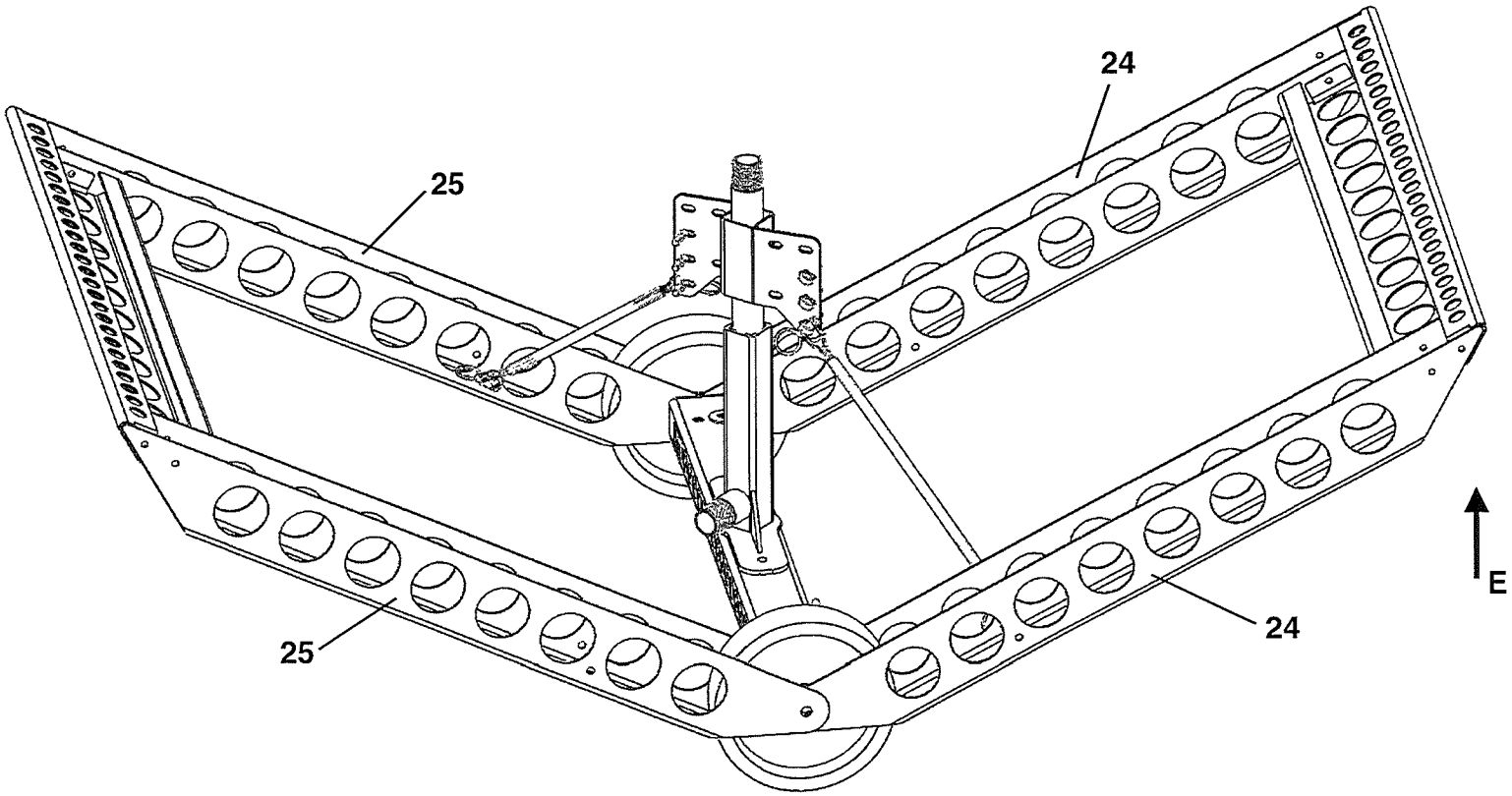
FIG. 5 is a top perspective view of the rooftop sprinkler of FIG. 1, configured in a partially folded position.

A hose 39 (shown for example in a dotted outline in FIG. 4) may be coupled to the hose coupling 33. Advantageously, as seen in FIG. 4, hose 39 is routed off to one side of the rear crossmember 23 and, optionally, through a hose support 38 mounted to the rear crossmember 23, and thence over the upper surface 23*b* of rear crossmember 23. In use, while the sprinkler is on the ground awaiting deployment, the hose 39 may be coiled up and laid on the ground right beside the sprinkler device 1 next to where the hose 39 is routed. Alternatively, the hose may be routed through one or more hose supports 38 positioned on other areas of the frame 20, such as on one or more of the front and rear skids 24, 25 and/or the front and rear crossmembers 22, 23. In other embodiments, wherein portions of the frame 20 are constructed of hollow tubes or pipes, the hose 39 may be routed through the center of such hollow portions of the frame 20.

In some embodiments, preferably the hose coupling 33 may be oriented at an angle $\alpha$ relative to the central crossmember 21, so that the hose inhibits uncontrolled spinning of the rooftop sprinkler device 1 as it is hoisted from the ground to the edge of a roof. For example, without intending to be limiting, in some embodiments the angle $\alpha$ (illustrated in FIG. 7) may be substantially 45°. Advantageously, when the rooftop sprinkler 1 is on the roof peak or ridge, the weight of the hose, or the weight of both the hose and the water in the hose 39 routed over the rear crossmember 23, effectively weighs down on and anchors the frame 20 and thereby provides additional stability to the frame 20 when water is flowing through the hose 39.

As viewed for example in FIG. 2A, central crossmember 21 further includes at least one, and preferably a pair of connection points 27, 27 mounted to the opposing distal ends 21*c*, 21*c* of the crossmember 21, the distal ends located proximate to the wheels 26, 26. The connection points 27, 27 are for coupling, attaching, or otherwise mounting a rigging assembly, which for example may include one or a combination of any of the following: hoisting or pulling line, tow line, throw line, lanyard, chain, or other flexible pulling or hoisting member. For example, in the embodiment of the present disclosure, a polyester, elongated V-shaped lanyard 6 (shown by way of example in dotted outline in FIG. 7), by coupling the two ends of the V-shaped lanyard 6 to the connection points 27, 27. The connection points may be, for example, D-rings mounted flush to a portion of the frame, such as the central crossmember 21 as shown in FIGS. 1-8, or as another example, the connection points may be somewhat elevated from a portion of the frame, such as for example utilizing eye hooks. The connection points may be members mounted to a portion of the frame, or alternately the connection points may be integrally formed as a part of the frame. Any form of connection points suitable for connecting a lanyard 6 to the frame 20 known to a person skilled in the art are included within the scope of the present disclosure. This embodiment is provided for illustration purposes only and is not intended to be limiting, as a person skilled in the art will appreciate that either a single connection point or a plurality of connection points 27, located other than on crossmember 21 of the frame 20, may also work and are within the scope of the present disclosure.

Regarding the pulling means for hoisting the sprinkler 1 or 101 to the roof, although many different solutions may be used, the applicant has found that using a combination of a lanyard or V-lanyard, a tow line and a throw line is effective for hoisting the sprinkler from a ground position while reducing the snagging of the pulling means on parts of the roof. For example, in one embodiment, a ⅜" diameter rope lanyard, or V-lanyard, which may be a rope in the range of 50 feet folded in half, and may be used to couple the pulling means directly to the two connection points (27 or 127) of the sprinkler. The tow line may be, for example, a 50 foot length of ¾" width webbing, which is sewn to the apex of the V-lanyard and is the line which is actually used for applying the pulling force to the sprinkler by a person standing on the ground beside the structure. In order to get the tow line from one side of the structure to the other, a third portion of the pulling means may be a throw line, which for example may be a 50 foot length of lightweight, ⅛" diameter rope or line which is coupled to the free end of the tow line, by sewing or other coupling means. The other end of the throw line is attached to a weight, such as a ball, as described below, and may be used in a throwing or launching device, such as a ball chucker or similar device, to throw the towing line connected to the throw line over the structure to the other side of the structure, where the tow line may then be used to hoist the sprinkler from the ground up to the roof. The combination of the tow line, throw line and V-lanyard described above may be collectively referred to herein as the pulling means or rigging assembly. It will be appreciated by a person skilled in the art that the dimensions and specifications of the different parts of the rigging assembly are not intended to be limited to that described above, and that other rigging assembly combinations or arrangements suitable for hoisting the sprinkler to the roof are intended to be included in the scope of the present disclosure.

A sliding bracket 40 includes two planar flanges 41, 41 protruding from a collar 43. A plurality of adjustment apertures 45 are provided on each of the flanges 41, 41, as shown for example in FIG. 1. The adjustment apertures 45 on each flange 41, 41 are for coupling each of the two support arms 47*a*, 47*b* to the bracket 40 at a first end of each support arm. The opposite end of one support arm 47*a* is coupled to a front skid 24, and the opposite end of the other support arm 47*b* is coupled to a rear skid 25. This provides additional support and stability to the mast 30 relative to the frame 20, and also provides a mechanical coupling between the mast 30 and frame 20. The support arms 47*a*, 47*b* preferably assist with maintaining the mast 30 in a substantially orthogonal orientation relative to the clamshell frame 20 when in the frame's open position. In other embodiments, the support arms 47*a*, 47*b* preferably assist with maintaining the mast 30 in a substantially orthogonal orientation relative to the ground beneath the structure on the roof of which the sprinkler 1 is deployed.

In the embodiment illustrated in FIGS. 1-8, the support arms 47*a*, 47*b* are rigid and may be lengthened or shortened by small amounts, such as for example support arms 47*a*, 47*b* that have turnbuckles for length adjustment. However, this embodiment is not intended to be limiting and it will be understood by a person skilled in the art that semi-rigid support arms, such as those made of stiff wires, thin rods or plastic strips that are capable of flexion, and rigid support arms that are not capable of having their lengths adjusted, may also work and are within the scope of the present disclosure.

Preferably, the adjustment apertures 45 on the bracket 40 may be utilized so as to adjust the length and positioning of one or both of the support arms 47*a*, 47*b*. This adjustment allows the angular inclination of the front or rear skids 24, 25 relative to the mast 30 to be adjusted, which allows the rooftop sprinkler 1 to be positioned on symmetrical or asymmetrical roof ridges or peaks of various configurations. For example, a default configuration may be to couple the support arms 47*a*, 47*b* to the two bottom holes 45*a*, 45*a* in the sliding bracket, which is most suitable for deploying the sprinkler 1 over the roof line on the most common symmetrical roof peak designs, as shown for example in FIG. 1. However, if an asymmetrical roof design is encountered, where one side of the roof is steeper than the other, a simple adjustment may be made at the sliding bracket 40 by unclipping the one of the support arms 47*a* or 47*b* located on the side of the sprinkler 1 which will be resting against the flatter side of the roof and moving it to a higher position, for example by coupling support arm 47*b* to aperture 45*b* while leaving support arm 47*a* coupled to aperture 45*a*.

Preferably the frame 20 of rooftop sprinkler 1 is relatively simple to maintain and repair. For example, each of the front and rear skids 24, 25 may be identical or otherwise interchangeable. The front and rear crossmembers 22, 23 may also be identical or otherwise interchangeable. The mast 30 may be removed and easily replaced in the field. Advantageously, by making the skids 24, 25 and crossmembers 22, 23 interchangeable, spare parts inventory for the rooftop sprinkler 1 may be made quite minimal relative to the number of rooftop sprinklers 1 in service for a particular fire department, for example. Preferably, the skids 24, 25 are made of rigid, hardened materials, such as stainless steel, so as to prevent damage to the lower surfaces of these components when translating across various roofing materials, thereby reducing the possibility of introducing gouges or grooves to the lower surface 20*a* of frame 20 which may otherwise increase the frictional force that must be overcome when translating the frame 20 over a surface. However, it will be appreciated by a person skilled in the art that other rigid or semi-rigid materials, including softer materials that are susceptible to surface damage (such as aluminum or plastic), which may have a hardened coating or liner on wear surfaces, may be utilized in the construction of the components of the frame 20 and are also intended to be within the scope of the present disclosure. The other components of the frame 20, such as for example the crossmembers 21, 22 and 23, may preferably be made of a lighter weight material, such as aluminum, plastic or other suitably strong and lightweight materials known to a person skilled in the art.

The moving parts of the couplings 28, 28 may be set with washers manufactured of Teflon™, Nylon™, stainless steel or any other suitable materials, so as to reduce friction and the pivotal couplings 28, 28 and advantageously improving the ability of the frame 20 to self-adjust over a roof line or peak once or as pulled into position. In some embodiments, the rooftop sprinkler may preferably be manufactured so as to make it relatively lightweight, for example approximately eight pounds, so as to facilitate firefighters carrying a plurality of rooftop sprinklers 1 to a particular area for deployment on a structure and to make the process of hoisting the sprinkler up to an elevated position on a roof easier for the person on the ground to accomplish. For example the rooftop sprinkler 1 may be constructed of lightweight materials and/or the components of the frame 20 may be provided with a plurality of apertures 3 (a representative number of apertures 3, for example, are labelled in FIGS. 2 and 3) to thereby reduce the weight of those components. For example, an embodiment of the rooftop sprinkler 1 comprises a frame 20 constructed of stainless steel and aluminum, the frame measures approximately 21 inches by 42 inches when in the open position as illustrated for example in FIG. 3, and weighs approximately eight pounds.

These specifications of an embodiment in accordance with the present disclosure are provided by way of example only, and it will be appreciated by a person skilled in the art that rooftop sprinklers constructed of various materials and dimensions, and of various different weights, and having differing ranges of freedom of motion about the pivotal coupling between the front and rear skids, are also possible and within the scope of the present disclosure. For example, the frame 20 may be partially or fully constructed of one or more hollow tubes or pipes, which hollow tubes or pipes may be in fluid communication with the hose connector 33, whereby the hollow, sealed portions of the frame may be filled with water when a hose 39 is attached to the hose connector 33 and water is supplied through the hose. Such an embodiment, with a frame at least partially constructed of hollow and preferably sealed members, advantageously provides a sprinkler which is relatively lightweight when no water is contained within the hollow portions of the frame for ease of transporting the sprinkler to a structure and hoisting the sprinkler to a roof, and increasing the weight and stability of the frame of the sprinkler when the hollow portions of the frame are filled with water during, for example, deployment and use of the sprinkler on the top of a roof. In a further alternative construction of the frame, the front and rear skids may be solid, rather than a pair of arms, to each provide a plate-like sliding surface for translating the frame over a roof edge and across a surface.

In a further embodiment of the present disclosure, as illustrated in FIGS. 9-13, a roof sprinkler 101 includes a clam shell frame 120, the clam shell frame 120 including a pair of front skids 124 connected by a front crossmember 122 and a pair of rear skids 125 connected by a rear crossmember 123. The frame 120 further includes a central crossmember 121 to which the pairs of front and rear skids 124, 125 are pivotally attached at pivotal couplings 128. Translation means, such as for example a pair of wheels 126, 126 may also be rotationally mounted to the central crossmember 121.

Figure 9:
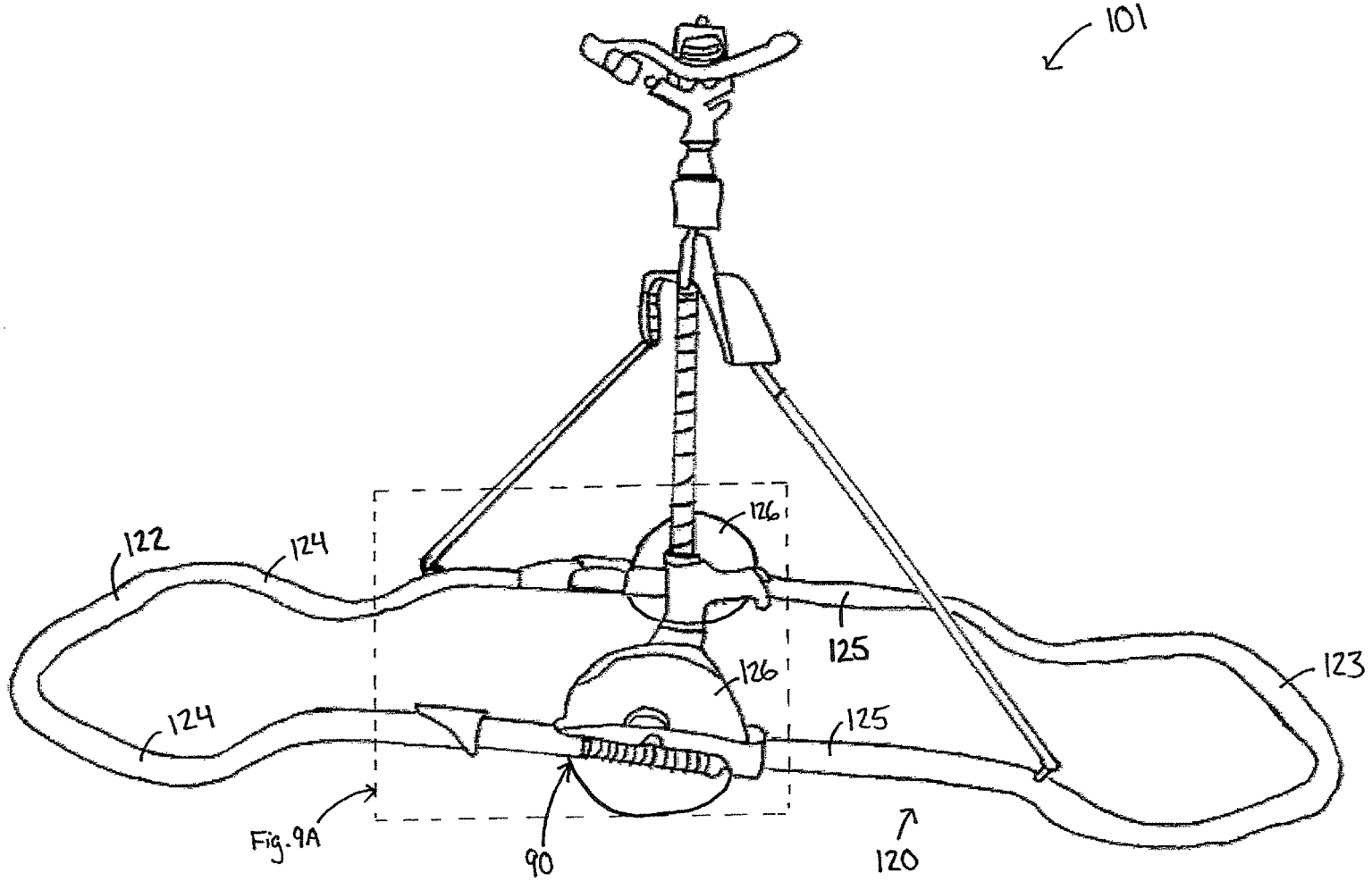
FIG. 9 is a side perspective view of an embodiment of the rooftop sprinkler device disclosed herein, shown in a fully extended position.
Figure 9A:
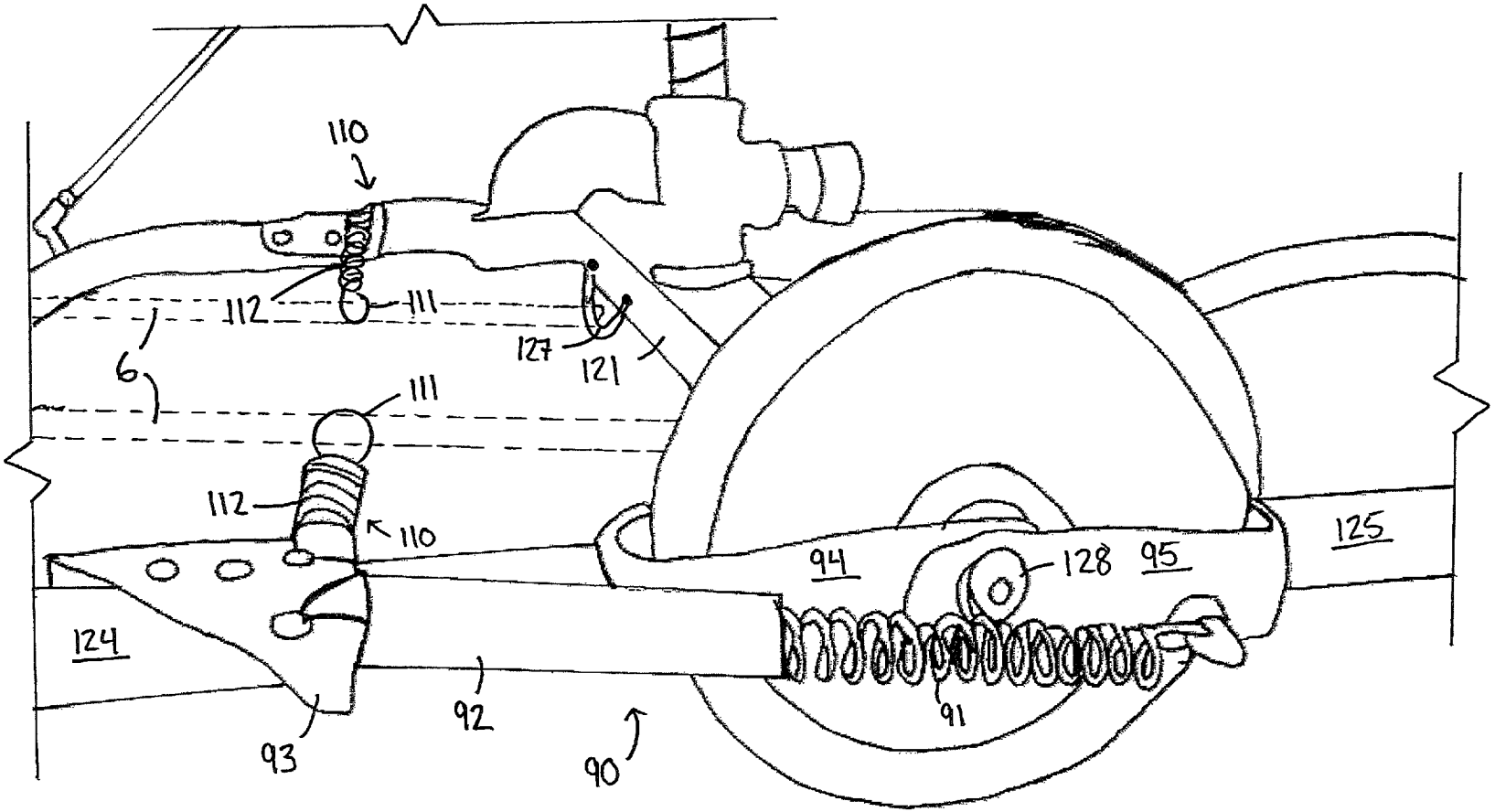
FIG. 9A is a close up view of a portion of the sprinkler shown in FIG. 9.
Figure 12:
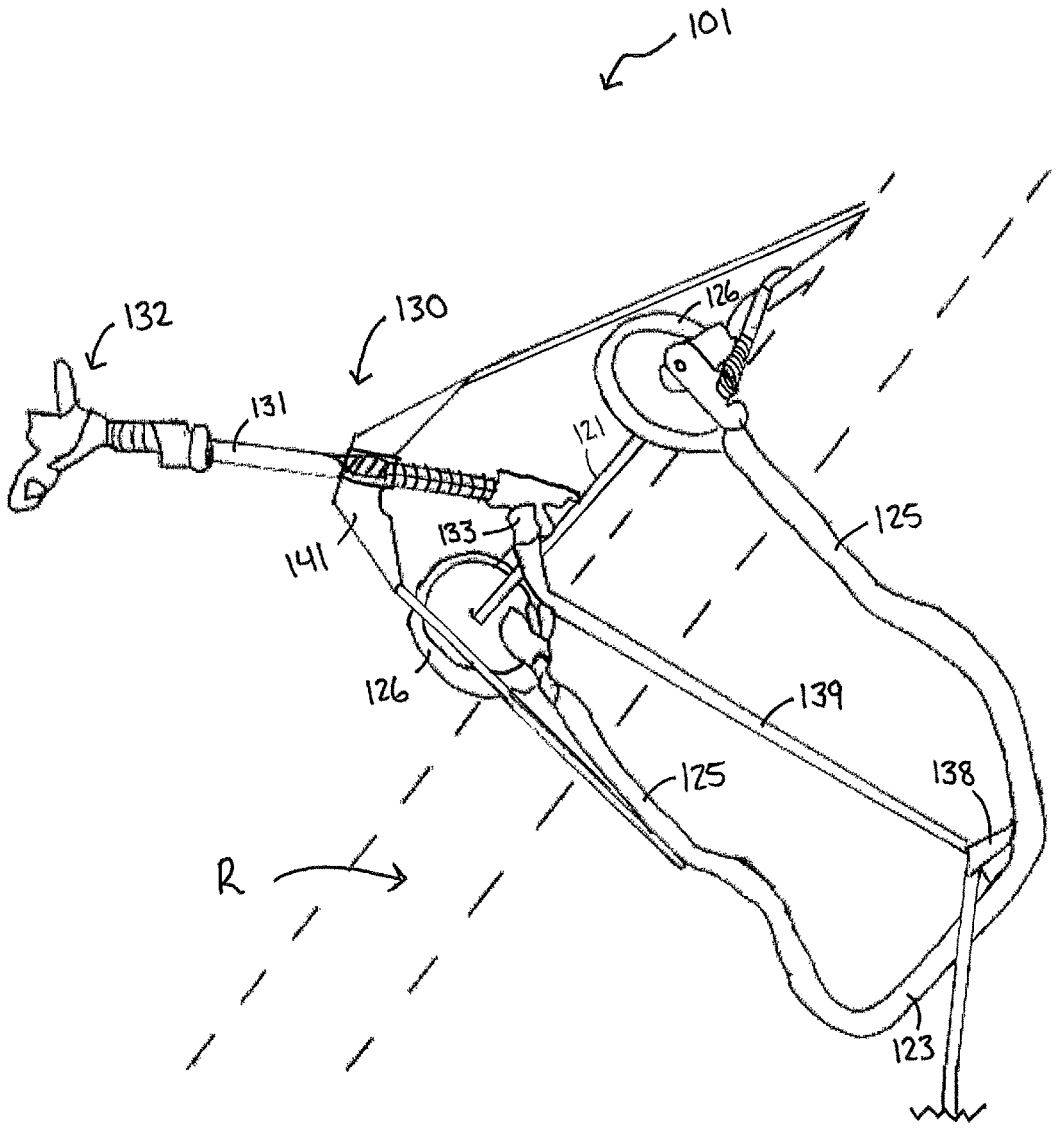
FIG. 12 is a side perspective view of the sprinkler of FIG. 9, illustrating the orientation of the sprinkler as it is being pulled to a roof.
Figure 13:
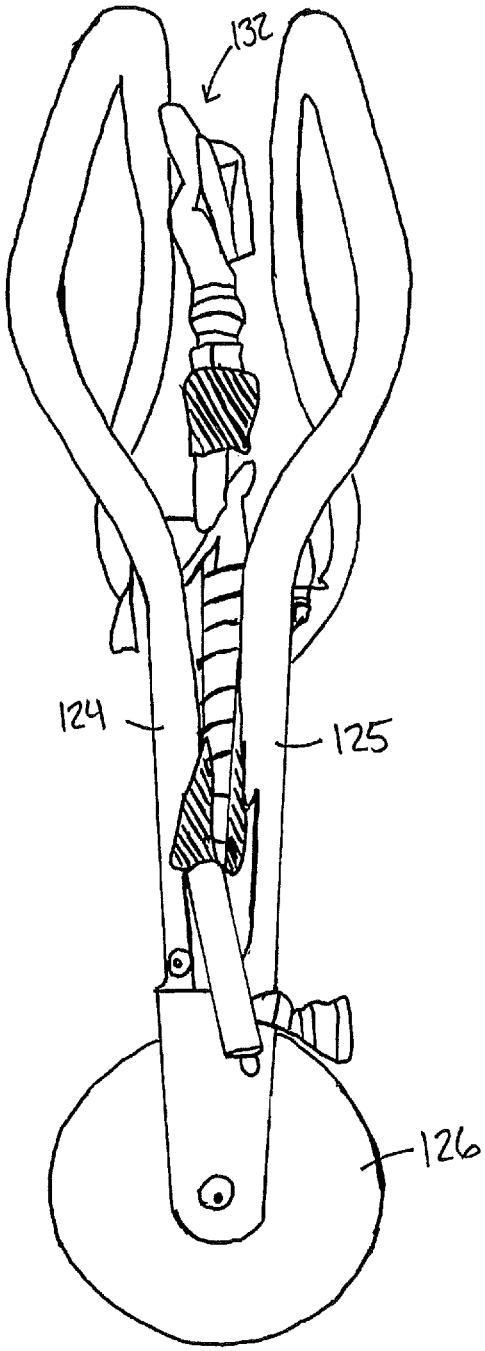
FIG. 13 is a side view of the sprinkler of FIG. 9, configured in a fully folded position.

The skids 124, 125 may be maintained under spring tension so that the frame 120 remains in the proper position during hoisting of the sprinkler 101 to a roof edge R, such as shown for example in FIG. 12, by means of a resilient tensioning device 90. The resilient tensioning device 90 may, for example, include a torsion spring 91 optionally encircled by a tube 92, the tube 92 serving to reduce or prevent the snagging of the spring 91 on roof tiles or other portions of a roof as the sprinkler 101 is being hoisted onto a roof. The resilient tensioning device 90 may be attached to a portion of each of the front and rear skids 124, 125. For example, without intending to be limiting, as illustrated in FIG. 9A one end of the resilient tensioning device 90 may be mounted to the rear wheel bracket 95 extending from an end of a rear skid 125 and the other end of the resilient tensioning device 90 may be mounted to a spring bracket 93, the spring bracket 93 secured to a front skid 124. However, this is not intended to be limiting and it will be appreciated by a person skilled in the art that the resilient tensioning device may be mounted to the frame 120 in various configurations so as to achieve mounting one end of the resilient tensioning device 90 to a front portion of the frame 120, such as a front skid 124 or the front wheel bracket 94, and the other end of the resilient tensioning device 90 to a rear portion of the frame 120, such as a rear skid 125 or the rear wheel bracket 95.

Figure 10:
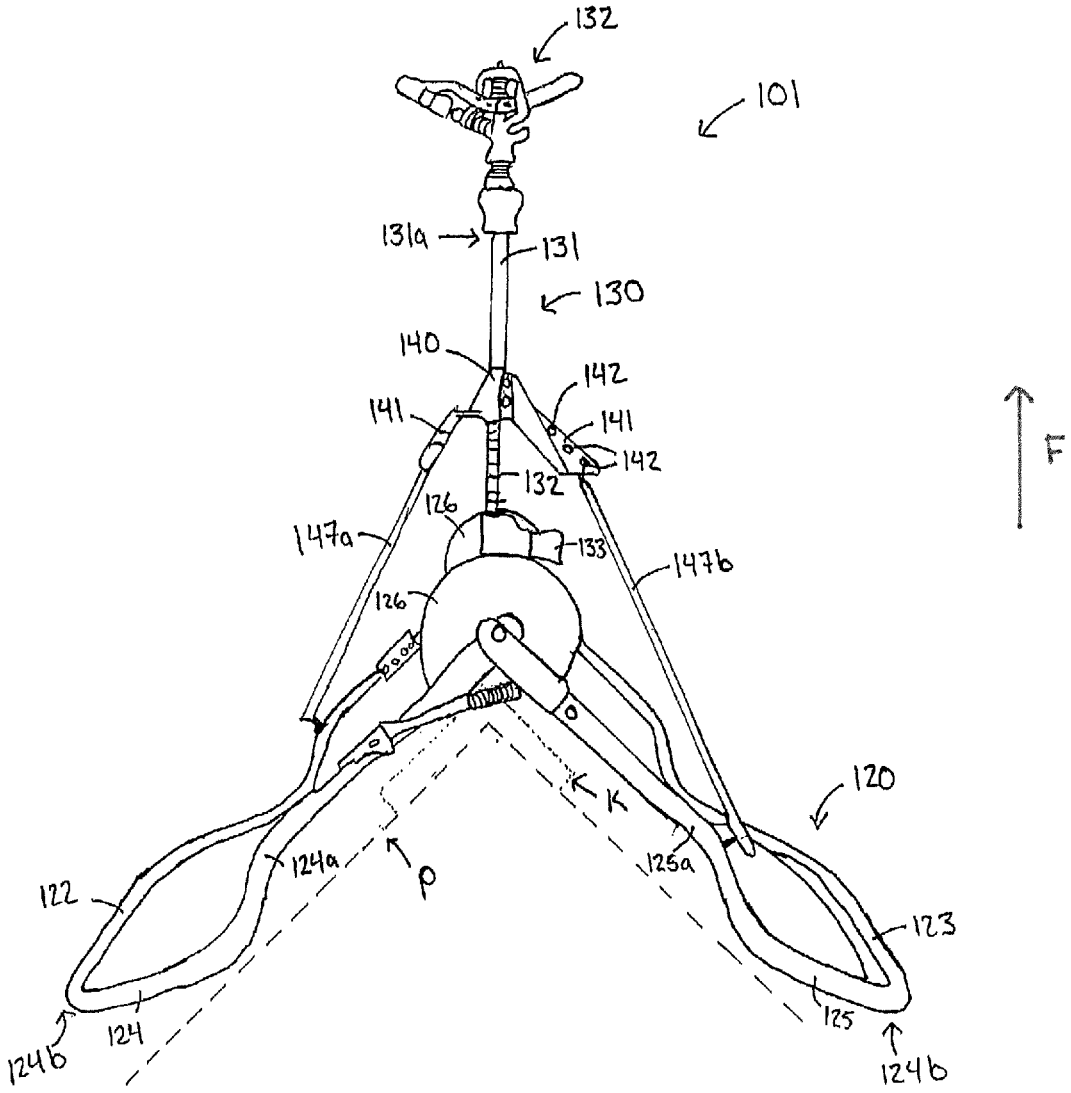
FIG. 10 is a side perspective view of the sprinkler of FIG. 9, configured in a position for a steeply pitched rooftop peak.

As seen for example in FIG. 10, first and second support arms 147*a*, 147*b* are adapted to support a sprinkler mast assembly 130 in a substantially upright position which is substantially orthogonal to the central crossmember 121. The mast assembly 130, in some embodiments of the present disclosure, may include an elongate, hollow mast 131, the mast 131 having a free end 131*a* to which a sprinkler head 132 may be releasably coupled, such as the sprinkler heads described above in this disclosure. The mast assembly 130 may also include a bracket having a bracket collar 140 encircling the mast 131 and bracket flanges 141, 141 extending outwardly from the bracket collar 140. The first and second support arms 147*a*, 147*b* may each be coupled to the flanges 141, 141 of the mast assembly bracket, for example by wing nuts or other suitable fasteners for fastening the mast ends of support arms 147*a*, 147*b* to apertures located on the bracket flanges 141. Optionally, a plurality of adjustment apertures 142 may be positioned in an array across the flange 141 so as to configure the positioning of the support arms 147*a*, 147*b* to account for different angles of various roof peaks P. The mast assembly may further include a hose coupling 133 for coupling a hose to the mast assembly 130, such that water may be supplied through the hose to the sprinkler head 132 when the sprinkler 101 is deployed for use.

Additionally, in the embodiments illustrated in FIGS. 9-13, the mast assembly may further include a mast spring 132, the mast spring encircling the mast 131 and positioned between and abutting against the bracket collar 140 at one end of the spring and the hose coupling 133 at the other end of the spring. As the collar 140 is slidably mounted to the mast 131 so as to allow the bracket to slide up and down the mast as the skids 124, 125 move towards or away from each other, the spring 132 serves to urge the collar 140 upwardly in direction F towards the free end 131*a* of mast 131, thereby assisting in maintaining the frame 120 and mast 131 in the desired position. Advantageously, the spring 132, in some embodiments, may also be under torsion such that the spring 132, coupled to the bracket collar 140, may rotate for example in a clockwise rotational direction X, so as to position the flanges 141, 141 of the bracket in the same plane as the folded pairs of skids 124, 125 when the sprinkler 101 is folded for compact storage, as best seen for example in FIG. 11.

Regarding the front and rear skids 124, 125, in some embodiments of sprinkler 101, the skids may be constructed of a hollow tube made of a strong material, such as stainless steel tubing or any other suitable material. The shape of the skids 124, 125 may be modified so as to include a slight upward curve 124*a*, 125*a*, shown for example in FIG. 10, so as to provide clearance for the ridge caps K that may be along the roof ridge of certain roofs, thereby providing better stability to the frame 120 when it is positioned over a roof ridge or peak P (those terms being used interchangeably herein). In some embodiments, the skids may also include an upward curve 124*b*, 125*b* where the front and rear skids each connect with the front and rear crossmembers 122, 123. This slight upward curve 124*b*, 125*b* thereby slightly elevates the front and rear crossmembers 122, 123 from the surface of the roof as the sprinkler 101 traverses across the roof as it is being hoisted towards the peak P, and thereby assists in reducing or preventing the front and rear crossmembers 122, 123 from catching on roof tiles or other features that may protrude from the roof's surface.

Figure 11:
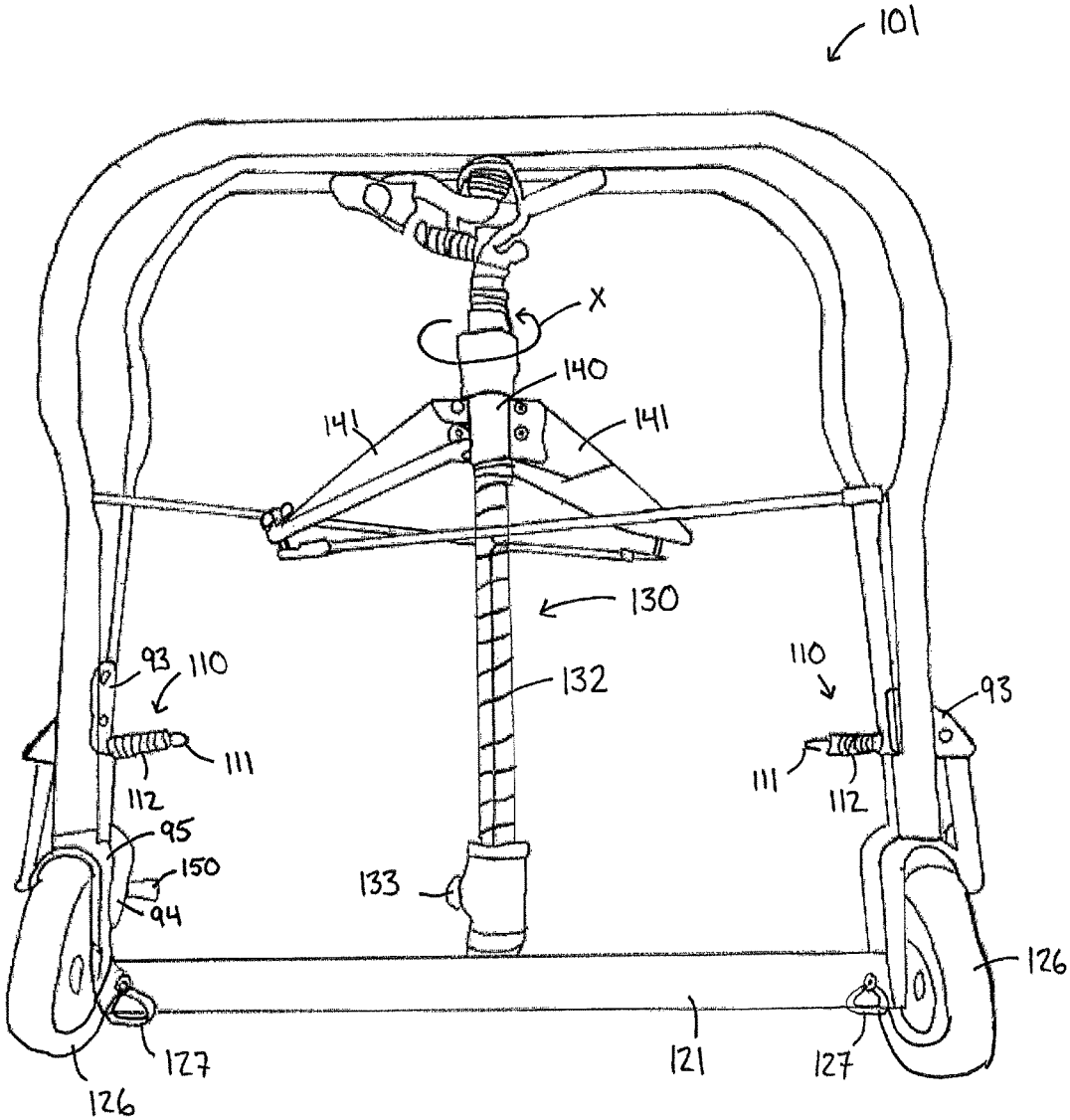
FIG. 11 is a front view of the sprinkler of FIG. 9, configured in a fully folded position.

To hoist the sprinkler 101 to a roof or roof peak P, a Y-shaped or V-shaped lanyard 6 may have the free ends of the lanyard each coupled to a connection point 127 mounted to and spaced apart along the central crossmember 121, for example a D-ring as shown in FIG. 11. The connection point 127 may extend from a lower edge of the central crossmember 121, as best seen in FIG. 9A. Once each free end of the lanyard 6 is coupled to a connection point 127, the lanyard may optionally also be routed through a hoist support 110, each hoist support 110 mounted to a front skid 124 for example by means of the spring bracket 93 which also supports the frame spring 91. A hoist support 110, for example, may each comprise an extension spring 112 and a loop 111 through which the lanyard 6 may be routed, as shown for example in FIG. 9A. The hoist support 110 thereby keeps each wing of the Y-lanyard 6 adjacent to its respective front skid 124, thereby helping to prevent the lanyard from becoming entangled or twisted as the sprinkler 101 is hoisted to an elevated position on a roof from a ground position beside the structure or building. The hoist support 110 also assists in preventing the sprinkler 101 from flipping backwards as it is being hoisted up to the roof and also helps to flip the rear skids 125 over the edge of the roof R after the wheels or other translation means 126, 126 have contacted the roof edge R, by more evenly distributing the tension force applied to the lanyard 6 during hoisting of the sprinkler.

To further assist with maintaining the sprinkler 101 in the desired, opened position with the mast assembly 130 substantially upright while hoisting the sprinkler 101 to the edge of a roof R, as best seen in FIG. 12, in preparing the sprinkler for hoisting to a roof, the hose 139 is firstly routed through a hose support 138, such as for example a loop mounted to rear crossmember 123, and then attached to the hose coupling 133. Advantageously, this arrangement causes the hose to rest against the rear crossmember 123 while the sprinkler 101 is being hoisted to an elevated position on the roof and the weight of the hose 139 resting against the rear crossmember 123 thereby provides further stability to the frame 120 during the hoisting of the sprinkler 101.

In use, the rooftop sprinkler 1 or 101 is deployed on a rooftop from the ground by firstly throwing a tow line, such as a rope for example, over the rooftop to be protected, and then attaching a pulling means, such as for example a V-shaped lanyard 6, to the connection points 27, 27 (or 127, 127) on the rooftop sprinkler 1 or 101 and to the towing line. The firefighter or other user of the sprinkler 1 or 101 then hoists the rooftop sprinkler from the ground to the roof by pulling on the tow line from the opposite side of the structure where the sprinkler is located.

The size of the structure to which the roof sprinkler 1 or 101 will be deployed will determine the method used to get the tow line or rigging assembly over the roof. If it is a smaller, single story structure, it is often easiest and quickest to use, for example, a weighted tennis throw ball connected to the tow line attached to the lanyard, or, the throw ball directly attached to the sprinkler's lanyard 6 if the lanyard is sufficiently long. The tennis ball may have a short piece of bungee attached so that a person can get more distance by manually swinging the line and ball and releasing the line so the ball flies over the roof. Often on a steep tall roof, the weighted ball just has to make it over the peak and then gravity will pull the ball down the other side.

To get a tow line over the peaks of larger structures, a ball chucker setup has been proven to be very fast, accurate, durable and effective. As mentioned above, in the case of larger structures a throw line may be attached to a tow line which in turn is attached to the V-lanyard, the throw line being of a lighter weight material so as to assist with throwing the rigging assembly over a larger distance. A ball chucker may be merely an off the shelf dog ball throwing stick that holds a tennis ball at one end and has an elongate handle. Use of the ball chucker may increase the distance and accuracy of the trajectory of the rigging assembly, including the tow line, over the roof. The chucker can be used in two ways:

1) Place a weighted throw ball coupled to a ⅛" throw line into the chucker and launch the ball over the roof.
2) If greater throw distance is required, the chucker can be modified by attaching a fishing reel near the handle and installing an eye hook near the ball holder of the chucker. The rubber, weighted ball is connected to the line of the fishing reel that is attached to the handle of the chucker. The weighted, rubber tennis ball will carry with it the lightweight, high strength fishing line out of the fishing reel, through the eye hook and over most structures. Once the ball has been located on the other side of the structure, the ball is unclipped from the fishing line and is clipped to the ⅛" throw line end from the mesh bag. The fishing line is reeled in and it will pull with it the lightweight towing line over the peak. Once the towing line is over the roof, the line is pulled over by hand until the sprinkler is situated over the peak or ridge of the roof.

Alternatively, there are a number of commercially available rope launchers available that work various ways, but in the applicant's experience, the simplest way to get the towing line over very large structures has been to use a regular fishing pole and to cast a rubber coated ball having a weight of substantially one to four ounces over the peak of the roof with a strong, flexible fishing line so that the weighted ball will cast out even farther. Collapsible-type rods have been used but it has been shown to be best to use a shorter, fairly sturdy, one piece fishing rod. A person skilled in the art will recognize that various other methods or tools may be utilized to position a pulling means, such as a rope, lanyard, towing line, chain or other elongated, flexible member over a roof, including for example the use of a drone or a helicopter to assist in positioning the pulling means over the roof, or any other suitable means, are within the scope of the present disclosure.

In some embodiments of the present disclosure, the lanyard 6 may be routed through the sprinkler 1 as follows: the lanyard couplings 5 attached to the webbing of the lanyard 6 are routed first under the front crossmember 22 and central crossmember 21 in direction B as shown in FIG. 3. Then the lanyard couplings 5, 5 are routed back towards the front crossmember 22 in direction C, passing through the rectangular apertures 21*d*, 21*d* of the central crossmember 21 (see FIGS. 2 and 7). The couplings 5, 5 are then coupled to the corresponding connection points 27, 27. In some embodiments the lower edges 21*e*, 21*e* of the central crossmember 21 are smooth so as to reduce friction on the webbing of the lanyard 6. Although connection points 27, 27 are shown on the upper surface 21*b* of crossmember 21 towards front crossmember 22 (in direction C), in some embodiments the connection points 27, 27, which may for example be D-rings, are positioned on the upper surface 21*b* of central crossmember 21 in direction B, towards the rear crossmember 23 so as to be behind the axis of rotation A (or in other embodiments, for example, behind the axle 29). This routing of the lanyard 6, in some embodiments of the present disclosure, serves to maintain the entire frame in position during hoisting to the roof, and preventing the frame from tipping backwards due to the weight of the sprinkler head coupled to the mast 30. Once the wheels or other translation means 26 get over the outermost edge of the roof, the rear skids 25, 25 (or skids 125, 125 in the case of sprinkler 101) push on the support arms 47*a*, 47*b* (or 147*a*, 147*b*) so as to leverage the mast 30 (or 130) forward and the sliding bracket 40 (or 140) pushes upwardly along the mast so as to move the gravity forward. In this manner the applicant has found the rear skids leverage the mast forward. The sprinkler 1 or 101 thus rolls itself over the roof edge with pulling tension applied to the tow line or rigging assembly while pulling from the ground by hand. Applicant has observed that this causes substantially no damage to the roof edge or roof peak.

Preferably the hose 39 weighs down the rear crossmember 23 of the sprinkler 1 to help it maintain the proper positioning in the air and the position of the hose 39 exiting to one side of the frame 20 contributes to keeping the sprinkler 1 from spinning as it is hoisted over the eavestrough or gutter of the roof and onto the surface of the roof. Advantageously the translation means of the sprinkler 1, such as by way of illustrative example the wheels 26, 26, are the first portion of the sprinkler 1 to initially contact the edge of the roof, or the gutters or eavestrough of the roof (collectively the roof edge), as shown for example in FIG. 8, wherein the approximate orientation of the sprinkler 1 as it is being hoisted or hauled up along the side of a structure towards the edge of a roof, is illustrated.

The bracket 43 is positioned over the lower portion 32 of mast 30 for normal operation and is positioned over the upper portion 34 of mast 30 when folding the sprinkler frame 20 for storage. To prepare the sprinkler for hoisting onto a roof, the collar stopper 44, shown for example in FIG. 2, is loosened and slid along the upper portion of mast 34 so as to be adjacent the sprinkler coupling 35. Collar stopper 44 functions as a stopper for the sliding bracket 40 to keep the sprinkler frame 20 from folding closed while it is being hoisted up to a roof.

Alternatively, such as the embodiments shown in FIGS. 1-13, a lock pin 150 which is journaled through a bore passing through a front wheel bracket 94, as shown for example in FIG. 11, may be extended through the bore so as to abut against an edge of the adjacent rear wheel bracket 95 so as to prevent the frame 120 from folding backwards while being hoisted to an elevated position on a roof. To unlock the frame 120 for folding and storage, the lock pin 150 is retracted, thereby allowing front wheel bracket 94 to slide over rear wheel bracket 95.

Alternatively, referring to the embodiment illustrated in FIGS. 1-8, as the sprinkler 1 is folded by lifting the skids 24, 25 in an upwards direction E, the sliding bracket 40 begins to slide up the lower portion 32 of the mast 30 until it reaches the cylindrical, upper portion 34 of the mast 30. Due to the opposing forces applied to the sliding bracket 40 by the support arms 47*a*, 47*b*, the sliding bracket 40 will be pushed up the mast 30 as you lift the skids 24, 25 to the cylindrical upper portion 34 of mast 30 where the bracket 40 may freely rotate about mast 30. The lower portion 32 of mast 30 has a non-cylindrical geometry, and the collar 43 is sized and shaped so as to prevent free rotation of the bracket 40 about the lower portion 32. For example, the lower portion 32 may be a substantially rectangular prism with a cross-section substantially in the shape of a square, and the cross-section of collar 43 is substantially the shape of a square sized so as to enable the collar 43 to slide along the lower portion 32. This arrangement keeps the sliding bracket 40 in the correct orientation for normal operation of the sprinkler 1 where the support arms 47*a*, 47*b* preferably maintain the mast 30 in a substantially vertical position on the roof peak, regardless of what roof angle the sprinkler adjusts itself to as it articulates over the peak. However, it will be understood by a person skilled in the art that other orientations of the mast 30 are also possible, and that other designs for the geometry of mast 30, including designs in which the entire mast 30 is of one geometry, are also within the scope of the present disclosure.

Figure 6:
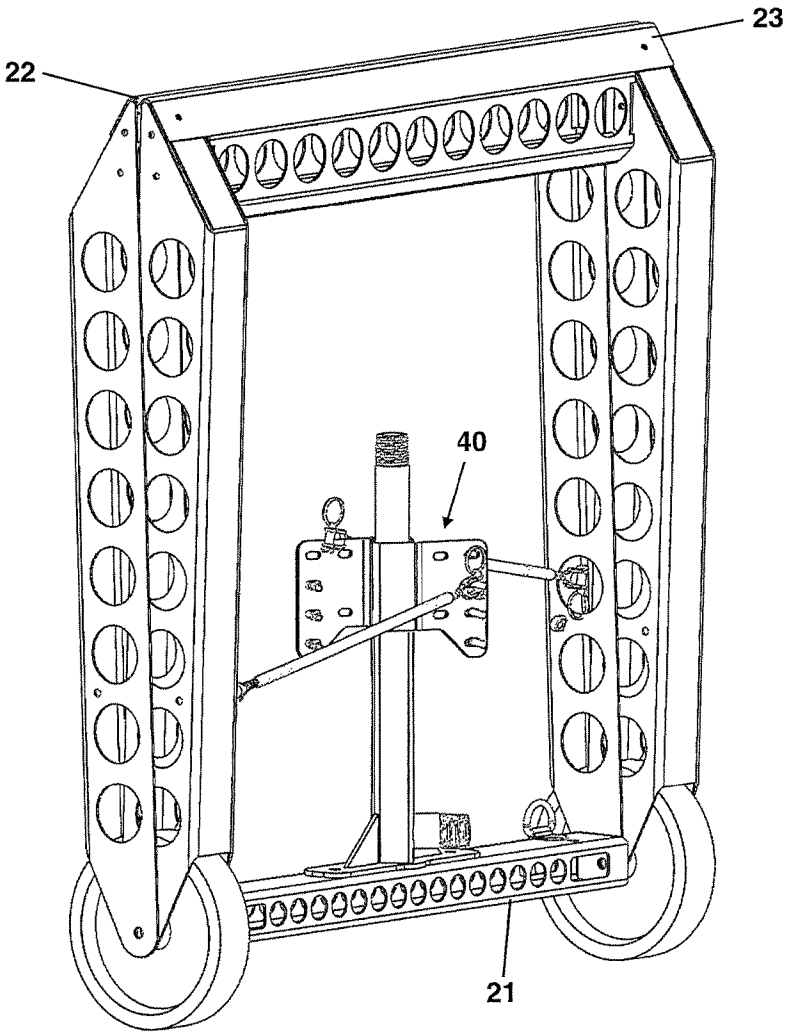
FIG. 6 is a side perspective view of the rooftop sprinkler of FIG. 1, configured in a fully folded position.
Figure 7:
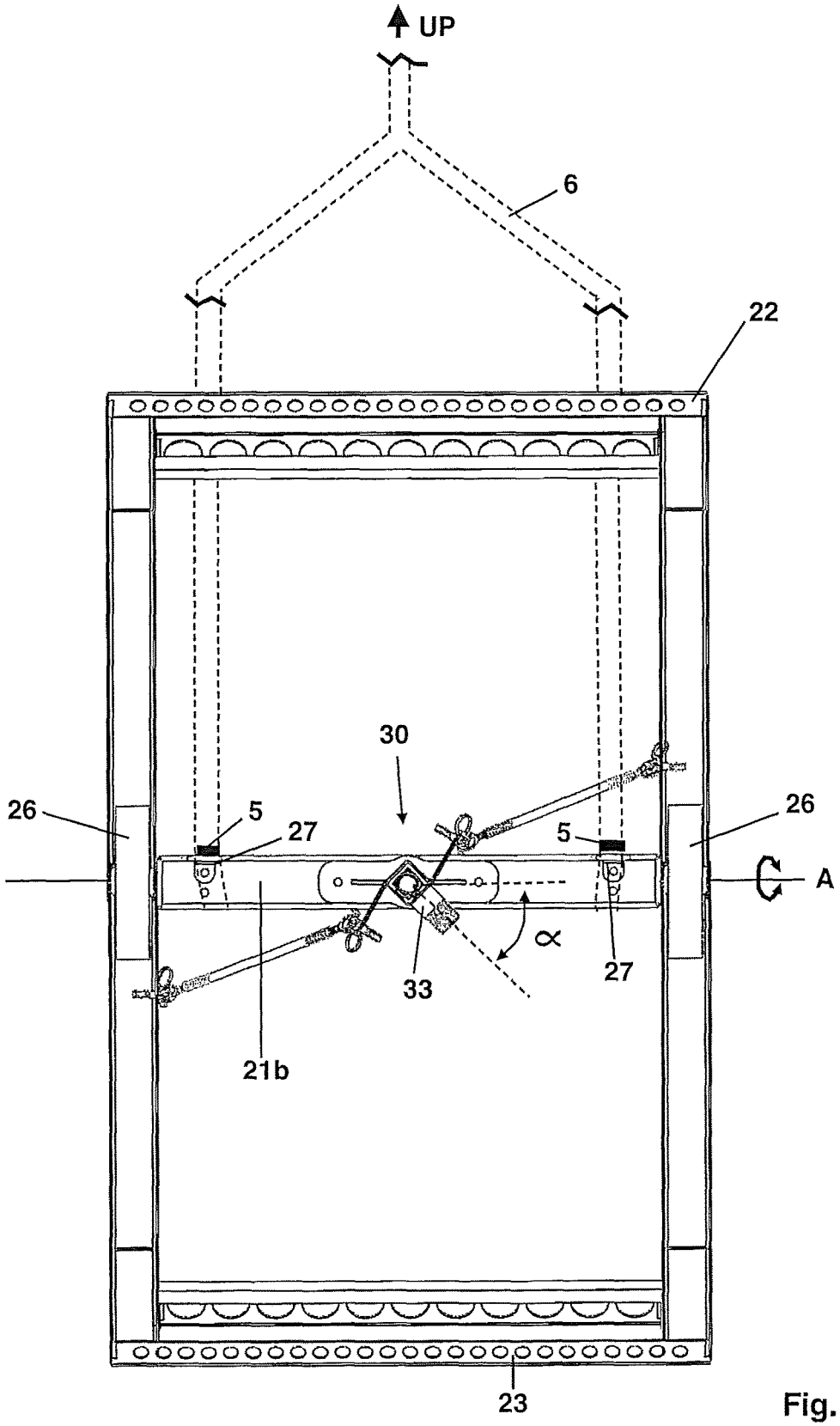
FIG. 7 is a top plan view of the rooftop sprinkler shown in the position of FIG. 4.

When the sliding bracket 40 slides away from the lower portion 32 and encircles the upper portion 34 of mast 30 where the bracket 40 may rotate about the upper portion 34, the support arms 47*a*, 47*b* coupled to the flanges 41, 41 apply a force to the sliding bracket 40, twisting the bracket 40 in direction Y so as to orient the flanges 41, 41 substantially parallel with the central crossmember 21, thereby enabling bracket 40 to position itself out of the way so the sprinkler unit lays flat when in a fully closed position, as shown in FIG. 6. The front and rear crossmembers 22, 23 come together to form a handle for carrying the folded sprinkler. This configuration also serves to protect the sprinkler mast 30 and coupling 35, and any sprinkler head coupled to the sprinkler coupling 35, from damage in storage and transport. The folded position of the sprinkler is similarly achieved in the embodiment shown in FIGS. 9-13, by retracting the lock pin 150 and thereby allowing the portions of the frame 120 to fold backwards such that front and rear crossmembers 122, 123 become adjacent, forming a handle by which to carry the folded sprinkler 101.

Furthermore, as the sliding bracket 40 rotates in direction Y as the front and rear skids 24, 25 are brought into a folding position, such an arrangement effectively shortens the distance the sliding bracket 40 must travel up the mast 30, advantageously enabling the sprinkler 1 to be folded with rigid support arms 47*a*, 47*b* without having to uncouple the support arms 47*a*, 47*b* from the bracket 40, and without having to extend the length of mast 30 beyond the length of the front and rear skids 24, 25. However, this design of the mast 30 is not intended to be limiting and a person skilled in the art will appreciate that other designs for the geometry of mast 30, including designs in which the entire mast 30 is of one geometry, are also within the scope of the present disclosure. In such embodiments, for example, the folding function of the frame so as to enclose the mast 30 and attached sprinkler head within the bounds of the folded frame 20 may also be accomplished by other means, such as for example embodiments requiring detachment of the support arms 47*a*, 47*b* from the sliding bracket 40, or other embodiments wherein one or more of the support arms 47*a*, 47*b* include a hinge so as to facilitate folding of the frame 20. It is understood by a person skilled in the art that these other embodiments also fall within the scope of the present disclosure.

Advantageously, the wheels 26 or 126 on the sprinkler 1 or 101 may serve the additional function of a dolly, enabling ease of transport of multiple sprinklers stacked vertically in a folded position. Due to their lightweight construction, the sprinklers may also be hung on backpacks for transport. The folded up front and rear crossmembers 22, 23 (or 122, 123) may become a carrying handle. The sprinklers, when in the folded configuration shown in FIG. 6 or 13, may also be advantageously stored in a stack or with either the crossmembers or the skids oriented vertically with respect to a surface on which they are stored, so as to facilitate storing the folded sprinklers side-by-side in a manner analogous to books stored on a shelf, thereby minimizing storage space.

Firefighters assess what properties have the highest probability to be saved via their intervention. Interface firefighting strategies can be revised with the introduction of the rooftop sprinkler 1 or 101 to the structure defense team's equipment to save more properties. The ground deployment sprinkler system allows fire bosses to put sprinklers onto rooftops that would have been previously deemed too dangerous and time consuming to attempt. Rooftop sprinklers are installed in a fraction of the time of the traditional deployments. This makes the most efficient use of our firefighter manpower as they can do their jobs safer and faster without having to use ladders or climb roofs.

What is claimed is:

1. A rooftop sprinkler device for mounting to a roof having first and second surfaces disposed on opposite sides of a ridge at an apex of the roof, the device comprising:

a two-sided foldable frame adapted to be maintained in an opened position during said hoisting by the rigging assembly, the frame having an upper surface, a lower surface, a spaced apart pair of front skids pivotally coupled to a spaced apart pair of rear skids at a pivotal coupling so that the pairs of front and rear skids rotate relative to one another when the frame folds about an axis of rotation of the pivotal coupling, the pairs of front and rear skids having at least one crossmember therebetween, at least two wheels coupled to the frame adjacent the axis of rotation, the at least two wheels coupled so that a lower surface of the at least two wheels protrudes below the lower surface of the frame when the frame is in the opened position during said hoisting, two connection points spaced apart on the frame and positioned adjacent the axis of rotation, a sprinkler mast mounted to the frame so as to extend upwardly therefrom and adapted for the mounting of a sprinkler head on a free end of the mast, wherein the frame is hoistable by applying a pulling force to the rigging assembly when the rigging assembly is coupled to the two connection points, the frame hoistable from the ground position to the elevated position at the roof edge whereat the at least two wheels are stabilized relative to the edge of the roof by a spacing between the said spaced apart two connection points and the rigging assembly coupled thereto; and wherein during said hoisting, the at least two wheels first engage the roof edge and further hoisting urges the frame onto the roof before the frame engages the roof edge because of said protrusion and said frame being stabilized relative to the edge of the roof and being maintained in the opened position during hoisting; and wherein the at least two wheels translates the frame along the first and second surfaces and thereafter onto the apex of the roof as the pulling force is applied to the rigging assembly coupled to the two connection points; and wherein, when the frame is positioned on the apex of the roof the pair of front skids is positioned flush against the first surface and the pair of rear skids is positioned flush against the second surface of the roof and the axis of rotation is positioned on and along the ridge, thereby positioning the mast extending upwardly from the ridge.

2. The sprinkler of claim 1 wherein the crossmember is elongate and co-linear with the axis of rotation.

3. The sprinkler of claim 2 wherein the mast extends upwardly from the crossmember.

4. The sprinkler of claim 3 wherein the mast is orthogonal to the crossmember.

5. The sprinkler of claim 3 further comprising first and second support arms each having a mast end and a skid end, wherein the mast ends of the first and second support arms are pivotally coupled to the mast, the skid end of the first support arm is pivotally coupled to the pair of front skids, and the skid end of the second support arm is pivotally coupled to the pair of rear skids.

6. The sprinkler of claim 5 wherein the mast further includes a bracket, the bracket slidingly coupled to the mast, wherein the mast ends of the first and second support arms are coupled to the bracket and the bracket slides along the mast when an angle between the pair of front skids and the pair of rear skids changes.

7. The sprinkler of claim 6 wherein a mast spring encircling the mast is positioned between the at least one crossmember and the bracket so as to exert a force on the bracket towards the free end of the mast.

8. The sprinkler of claim 6 wherein the mast ends of the first and second support arms are releasably pivotally coupled to the bracket and the bracket comprises a plurality of adjustment apertures for coupling the mast ends to the bracket, wherein an angle between the mast and the pair of front skids or pair of rear skids may be adjusted by selecting the adjustment apertures for releasably coupling the mast ends of the first and second support arms to the bracket.

9. The sprinkler of claim 1 wherein the crossmember further comprises a front edge proximate the pair of front skids, the two connection points spaced apart along the front edge and proximate the lower surface of the frame.

10. The sprinkler of claim 9 wherein each skid of the pair of front skids further includes a hoist support for supporting the rigging assembly when the rigging assembly is coupled to the two connection points.

11. The sprinkler of claim 1 wherein the at least two wheels are rotationally coupled to the frame.

12. The sprinkler of claim 1 wherein the pair of front skids is connected to the pair of rear skids by a resilient tensioning device.

13. The sprinkler of claim 12 wherein the resilient tensioning device includes a spring under tension.

14. The sprinkler of claim 1 wherein the sprinkler mast further comprises a hose connector extending towards the pair of rear skids.

15. The sprinkler of claim 14 wherein the pair of rear skids includes two rear skids and a rigid rear crossmember extending between and coupled to each skid of the pair of rear skids, and wherein a hose connected to the hose connector rests on the rear crossmember thereby stabilizing the frame during the hoisting.

16. A method for deploying the roof sprinkler device of claim 1 on a roof of a structure when the device is positioned on a first ground position beside the structure, the method comprising the steps of:

a) coupling a hose to a hose coupling in fluid communication with the sprinkler mast of the device, b) coupling a rigging assembly to the at least one connection point, c) throwing a free end of the rigging assembly over the roof from the first ground position to a second ground position opposite the first ground position, the first and second ground positions separated by the structure, d) applying a hoisting tension to the rigging assembly from the second ground position so as to hoist the roof sprinkler from the first ground position to the outermost edge of the roof until the at least two wheels contact the outermost edge of the roof, e) further applying the hoisting tension to the rigging assembly until the frame is located centered on the ridge of the roof with the axis of rotation aligned along the ridge.

17. The method of claim 16 wherein the mast further includes a bracket slidingly coupled to the mast, wherein a first support arm is adjustably coupled to and extends between the bracket and the front portion of the frame and a second support arm is adjustably coupled to and extends between the bracket and the rear portion of the frame, wherein the method further includes adjusting an angle between the pair of rear skids or the pair of front skids and the sprinkler mast by adjusting the coupling of the first and second support arms to the bracket so as to adapt the angle to an angle between the first and second roof surfaces.

18. The method of claim 16 wherein the step of throwing a free end of the rigging assembly over the roof further includes attaching a weight to the free end and using a throwing device to throw the weight and the free end over the roof.

19. The method claim 16 wherein the hose coupling extends substantially toward the rear portion of the frame, wherein the step of coupling the hose to the hose coupling further includes coupling the hose to a hose support mounted on the rear portion of the frame.

20. The method of claim 16 further comprising operating the sprinkler device by supplying water to the hose so as to spray water from the sprinkler head coupled to an upper end of the sprinkler mast.

21. The method of claim 16, further comprising the steps of:

f) shutting off the water supplied to the hose, g) applying a downward tension to the hose or the rigging assembly so as to pull the roof sprinkler to the first ground position or the second ground position.

* * * * *